US006270027B1

(12) United States Patent
Premo

(10) Patent No.: US 6,270,027 B1
(45) Date of Patent: Aug. 7, 2001

(54) PALLET SHREDDING MACHINE

(75) Inventor: Kenneth Premo, St. Charles, IL (US)

(73) Assignee: Advance Lifts, Inc., Charles, IL (US)

( * ) Notice: Subject to any disclaimer, the term of this patent is extended or adjusted under 35 U.S.C. 154(b) by 0 days.

(21) Appl. No.: 09/395,119

(22) Filed: Sep. 14, 1999

(51) Int. Cl.[7] ..... B02C 17/14; B02C 1/08
(52) U.S. Cl. ..... 241/264; 241/266
(58) Field of Search ..... 241/266, 264, 241/248

(56) References Cited

U.S. PATENT DOCUMENTS

| | | | | |
|---|---|---|---|---|
| 2,123,827 | * | 7/1938 | Eyrick et al. | 83/63 |
| 3,627,213 | | 12/1971 | Thumm et al. | 241/151 |
| 4,194,698 | * | 3/1980 | Kosnowski | 241/236 |
| 4,253,615 | | 3/1981 | Koenig | 241/36 |
| 4,603,816 | * | 8/1986 | Panning | 241/266 |
| 4,757,599 | | 7/1988 | Bane | 29/564.3 |
| 4,903,902 | | 2/1990 | Hufnagel | 241/84 |
| 4,938,426 | * | 7/1990 | Koenig | 241/260.1 |
| 5,078,327 | * | 1/1992 | Kemetter | 241/36 |
| 5,233,932 | * | 8/1993 | Robertson | 110/232 |
| 5,263,654 | | 11/1993 | Young | 241/84.3 |
| 5,265,561 | * | 11/1993 | Crawford | 119/172 |
| 5,580,006 | | 12/1996 | Hennenfent et al. | 241/159 |
| B1 4,253,615 | | 8/1989 | Koenig | 241/36 |

FOREIGN PATENT DOCUMENTS

| | | | |
|---|---|---|---|
| 4209278 | * | 9/1993 | (DE) . |
| 1052254 | * | 11/1983 | (SU) . |

OTHER PUBLICATIONS

Franklin Miller, Taskmaster™, Delumper™, Crushers, Shredders, Delumper™ Twin–LP, Pipeline Delumper™, pipeline Continuous Mixers, Supreme™ Roll Mills and Vulcanator™ Powerful Granulators, Mar. 7, 1997, 23 pages.
Williams Patent Crusher & Pulverizer Company, Self–Clear Ripshear Shredder, Bulletin 961 R, 4 pages.
Williams Patent Crusher & Pulverizer Company, William Solid Waste Shredding Equipment—Rugged, reliable shredders and ancillary equipment for efficient fuel preparation and recycling of municipal and industrial wastes, Bulletin 980, 11 pages.
Shred Pax Corporation, 4 pages.
Shred Pax Corporation, Model AZ PAX, 2 pages.
SSI Shredding Systems, Inc., Information and Quotations on Series 25E Shredders, 25 pages.
Excalibur Industrial Shredders, Excalibur© Series Shredders Information, 23 pages.

* cited by examiner

*Primary Examiner*—Allen Ostrager
*Assistant Examiner*—William Hong
(74) *Attorney, Agent, or Firm*—Marshall, O'Toole, Gerstein, Murray & Borun

(57) ABSTRACT

A material shredding device is disclosed which comprises a power source, a first shaft and a second shaft disposed in generally parallel relation and being in communication with the power source for opposite reciprocating rotational movement about respective axes thereof, a plurality of blades attached to the first shaft and the second shaft which are interleaved so as to overlap over a central shredding area and undergo opposite reciprocating rotational movement with the shafts between first and second positions and a material feeding mechanism.

15 Claims, 4 Drawing Sheets

PALLET SHREDDING MACHINE

FIELD OF THE INVENTION

The invention relates generally to shredding machines, and, more particularly, to pallet shredding machines.

BACKGROUND OF THE INVENTION

Much of the manufactured products and produce moved in commerce are stored and transported on pallets. Pallets are typically constructed to have flat top and bottom surfaces formed of spaced wooden planks nailed to wooden runners, extending generally perpendicular to the planks. The top and bottom surfaces are separated by reason of the runners to form a center area having two open opposite ends where a forklift or other lifting device can easily insert lifting arms to pick up and move the pallet. Pallets are of a standard size and shape, making transportation planning easier which eases the flow and transportation of goods through commerce. While pallets are made of wood strong enough to withstand heavy loads and multiple trips through commerce, pallets can lose their strength due to breakage, moisture or general misuse. Accordingly, unusable pallets need to be discarded, which is widely recognized as a significant disposal problem.

While pallets can be sent to traditional landfills, this can be costly since discarded pallets take up a significant volume of space, much of which is air. By shredding a pallet, the storage space and cost of disposing of a pallet can be significantly reduced. In addition, it is possible to avoid the disposal of pallets by recycling the material that is generated by shredding pallets.

Previous methods of shredding pallets have involved large, complex machines requiring a significant monetary investment due to the complexity of these machines. Many of these machines use constantly moving, medium to high speed, unidirectional blades which are typically operated by large electric motors and large gear reducers to literally shred the pallets into smaller pieces. The high cost of these machines limits their economical use to high volume operations.

SUMMARY OF THE INVENTION

A material shredding device is disclosed which comprises a power source, a first shaft and a second shaft disposed in generally parallel relation and being in communication with the power source for opposite reciprocating rotational movement about respective axes thereof, a plurality of blades attached to the first shaft and the second shaft which are interleaved so as to overlap over a central shredding area and undergo opposite reciprocating rotational movement with the shafts between first and second positions and a material feeding mechanism. The material feeding mechanism has a stationary portion and a moveable door portion that moves on a hinge from a closed vertical position to an open horizontal position where waste material can be inserted. In an alternate embodiment, the entire material feeding mechanism can be pivoted on either a horizontal or vertical axis. The power source is at least one hydraulic cylinder and the hydraulic cylinders transfer power to the shafts through pivoting transfer arms. The shafts are held in place with removable bearing pins. The blades on the respective shafts are alternately disposed over a central shredding opening and the blades reciprocate in unison to grab and shred the waste material.

A method of shredding waste material is also disclosed. The waste material is fed to a material shredding device. The material shredding device has a power source that imparts opposite reciprocating movement to a first and second shaft through pivoting transfer arms. The shafts have blades attached that reciprocate from a first position to a second position, interleaving across a central shredding area, thereby grabbing and shredding the waste material.

DESCRIPTION OF THE PREFERRED EMBODIMENTS

Figure 1:
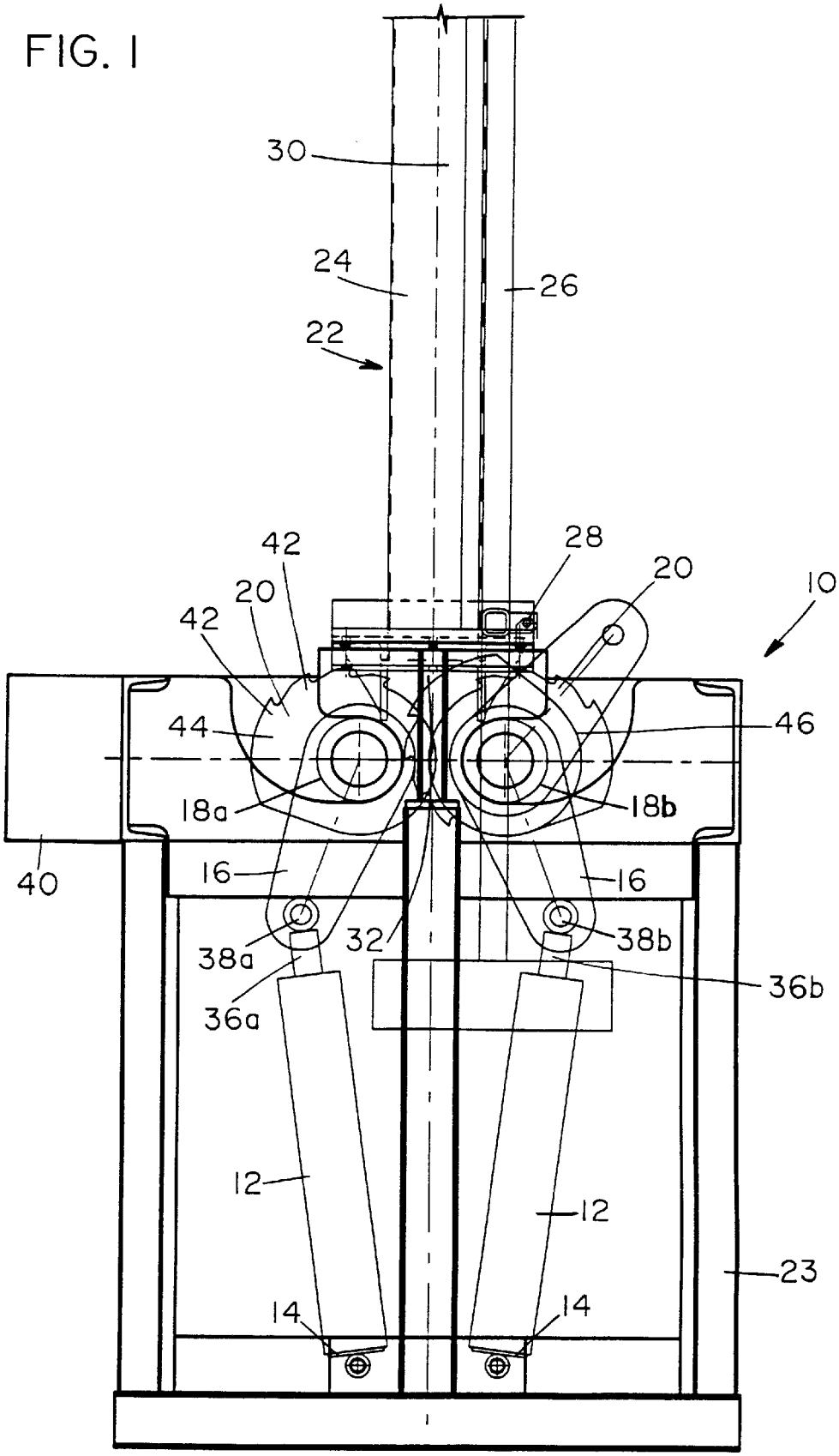
FIG. 1 is a partial cutaway, side view of a pallet shredding device in accordance with the teachings of the present invention illustrating one embodiment of the pallet shredding device.

Referring now to FIG. 1, a pallet shredding device 10 is disclosed. In one embodiment, the pallet shredding device 10 has two hydraulic cylinders 12 as power sources. The lower end of the hydraulic cylinders 12 are attached to the pallet shredding device 10 through the use of devises 14 and the upwardly extending pistons of the hydraulic cylinders 12 are connected to pivoting transfer arms 16. These pivoting transfer arms 16 are affixed to a first shaft 18*a* and a second shaft 18*b*, respectively. Affixed to the shafts 18*a* and 18*b* are a plurality of blades 20. The blades 20 receive a pallet or other waste materials to be shredded from a material feeding mechanism 22. The blades 20 attached to the shafts 18*a* and 18*b* are powered by the hydraulic cylinders 12 through the pivoting transfer arms 16. The blades 20 move together in a reciprocating manner to shred the pallet or other waste material, with the resulting waste material remnants falling through the bottom of the pallet shredding device 10.

The frame 23 of the pallet shredding device 10 can be made from any material strong enough to withstand the rigors of shredding pallets. For example, in the preferred embodiment, the frame is manufactured from steel. Further, while the device is referred to as a pallet shredder, the device is capable of shredding other waste material.

The material feeding mechanism 22 has a stationary portion 24 and a moveable door portion 26. The stationary portion 24 has a vertical orientation in the preferred embodiment, but could be at any angle relative to horizontal so long as the pallet to be shredded is fed by gravity and the action of the blades 20 in a manner that permits useful shredding. The moveable door portion 26 pivots on a hinge 28. In a first position of nearly vertical or closed orientation (see FIG. 1), the movable door portion 26 and stationary portion 24 are in contact or in near contact, creating a holding and feeding area 30 for pallets and the like which are to be fed to the pallet shredding device 10. Of course, the exact orientation of the stationary portion 24 and moveable door portion 26 could be a variety of arrangements so long as the pallet is held in an orientation for useful shredding to occur as a result of the pallet being fed by gravity and the action of the blades 20, as previously noted. It is desirable for the stationary portion 24 to be at an angle to horizontal, e.g. from about 60° to 120°, that fully accommodates pallets and the like to be gravity fed for shredding. A second position for the moveable door portion 26 is a below horizontal or open orientation, with the stationary portion 24 and the moveable door portion 26 being separated by ninety degrees plus or minus about forty-five degrees. Of course, the second position could be of any angle in relation to the stationary portion 24 so long as the pallet could be fed into a holding area 30 between the stationary portion 24 and the moveable door portion 26. When in the second position, the moveable door portion 26 is prepared to accept a pallet to be fed to the pallet shredding device 10. The moveable door portion 26 is then pivoted about the hinge 28 from the second position to the first position so that the pallet is raised from below horizontal orientation to a generally vertical orientation, directly over the central shredding area 32, ready to be gravity fed into the central shredding area 32 where it is grabbed and shredded by the blades 20.

In an alternate embodiment (not shown), the entire material feeding mechanism 22 (shown in FIG. 1) pivots on the hinge 28 from a first vertical position to a second horizontal position to allow a pallet to be easily slid into the holding area 30. The material feeding mechanism 22 is then pivoted on the hinge 28 from the second horizontal position to the first vertical position where the pallet is ready to be fed to the blades 20 for shredding. In this alternate embodiment, the material feeding mechanism 22 can be one contiguous unit or it can be two or more independently moveable portions which come together to form the material feeding mechanism and the holding area 30. In a further alternative embodiment (not shown), the entire feeding mechanism 22 (shown in FIG. 1) pivots vertically from a first position directly over the central shredding area 32 to a second position a rotational distance away from the central shredding area 32 where the pallet is loaded.

Figure 2:
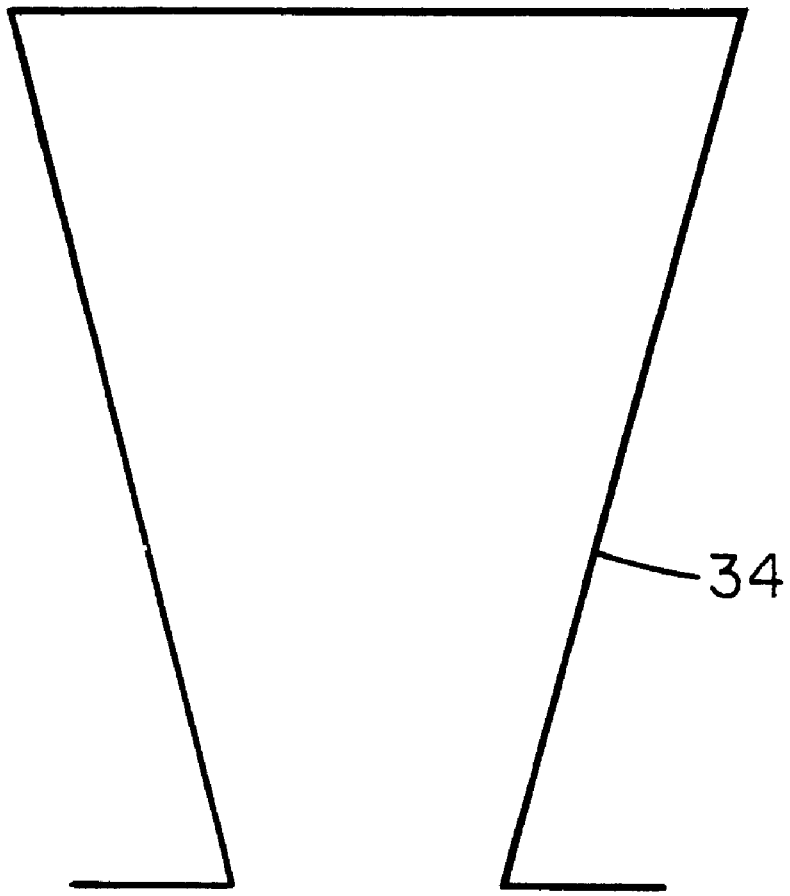
FIG. 2 is a partial cutaway, side view of a pallet shredding device in accordance with the teachings of the present invention illustrating one embodiment of the pallet shredding device.

Referring now to FIG. 2 in yet another embodiment, the material feeding mechanism is in the form of a hopper 34. The hopper 34 is wider at the top than the bottom, forcing pallets to adjust toward a preferred generally vertical orientation as they travel down the hopper 34. The hopper 34 can be fed pallets for shredding by hand or by another device such as a conveyor belt.

Of course, the material feeding mechanism could be constructed in a variety of shapes and have a variety of moveable features. In addition, the material feeding mechanism could be made from a variety of materials. The only criteria for the material is that it be capable of withstanding the wear from handling pallets on a routine basis.

In the preferred embodiment, the power source for the pallet shredding device 10 advantageously comprises two hydraulic cylinders 12, each supplying power to a respective one of the shafts 18*a* and 18*b* through the corresponding one of the pivoting transfer arms 16. The hydraulic cylinders 12 could each be of any conventional type which is rated to supply a force of 38,000 lbs. and have an extension adequate to rotate the blades sufficiently to shred a pallet. One such cylinder is currently manufactured by Advance Lifts, Inc. Of course, there are a variety of acceptable methods of using hydraulic cylinders to deliver the desired force to the shafts 18*a* and 18*b*. For example, in an alternate embodiment (not shown), a single hydraulic cylinder can be used to supply power to both of the shafts 18*a* and 18*b* by appropriately utilizing linkages, gear boxes or the like. In yet another embodiment (not shown), a pair of hydraulic cylinders 12 can be used to supply the desired pressure to the opposite ends of each of the shafts 18*a* and 18*b*.

In the preferred embodiment, the lower end of hydraulic cylinders 12 are connected to the frame 23 of the pallet shredding device 10 through the use of devises 14. Pistons 36*a* and 36*b* extend upwardly from the hydraulic cylinders 12 and are pivotally connected to the pivoting transfer arms 16. In one embodiment, the pivoting transfer arms have bearings 38*a* and 38*b* to which the pistons 36*a* and 36*b* connect using a suitable pin, bolt or any like connecting means.

The hydraulic cylinders 12 are controlled using a controller 40 which causes the pistons 36*a* and 36*b* to be fully extended and retracted, creating the reciprocating action of the blades 20 responsive to a suitable conventional double acting or reversible hydraulic circuit that is in hydraulic fluid communication with the hydraulic cylinders 12.

In addition to using hydraulic cylinders 12 to supply power to the pallet shredding device 10, other power sources could be used, e.g., an electric motor with sufficient horsepower could be used through a gear box or any other power transmission device to power the pallet shredding device 10.

In the preferred embodiment, the pivoting transfer arms 16 each have a bearing 38*a* and 38*b* in which the extended end of one of the pistons 36 of the corresponding one of the hydraulic cylinders 12 is connected. The bearings 38*a* and 38*b* can be of any type capable of withstanding the pressure applied by the hydraulic cylinders 12. The pivoting transfer arms 16 can also be made from any material strong enough to withstand the pressure applied by the hydraulic cylinders 12. In the preferred embodiment, the pivoting transfer arms 16 are made of steel and are attached to the shaft 18 in such a manner that the transfer pivot arm 16 will not slip around the shaft 18.

The shafts 18 can also be made from any material strong enough to withstand the torque applied. In the preferred embodiment, the shafts 18 are made from steel and are commonly available through industrial supply catalogs.

The blades 20 are attached to the shafts 18 in any suitable manner such as welding to render them integral with the shafts for reciprocating movement therewith. The blades 20 could be made from any material tough enough to withstand repeated use for shredding pallets. For example, the blades in the preferred embodiment are made from steel and are manufactured by Advance Lifts, Inc. The blades 20 preferably have teeth 42 around a 120° segment of the blade 20 since the blade 20 rotates approximately 120 degrees. In the preferred embodiment, each individual blade 20 has four teeth 42 disposed about approximately 90 degrees of the perimeter thereof. However, each blade 20 can have any number of teeth 42 which covers any portion of the perimeter so long as there are enough teeth to successfully perform a given shredding operation.

Figure 3:
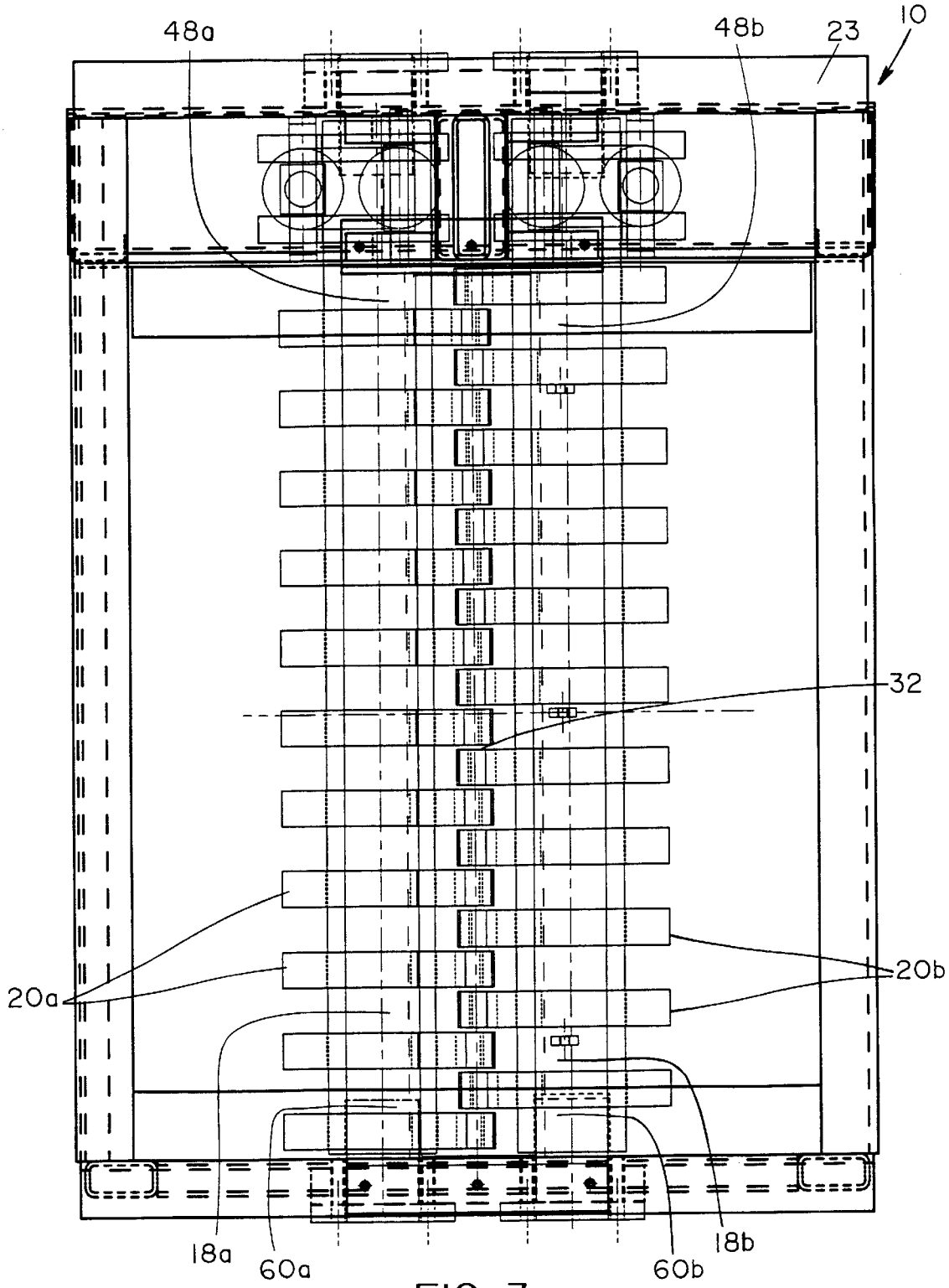
FIG. 3 is a partial cutaway, overhead view of a pallet shredding device in accordance with the teachings of the present invention illustrating one embodiment of the pallet shredding device.

Referring to FIG. 3, the blades 20 can also be formed of any thicknesses so long as the blades 20 have the strength to effectively perform a given shredding operation. For example, in the preferred embodiment, the blades 20 are approximately two inches thick to have the required strength to shred a pallet. In addition, the blades 20 can be formed of any diameter so long as the blades are of a size and arrangement such that they overlap the central shredding area 32 and allow the pieces of material that has been shredded to flow through the shredding device 10. In the preferred embodiment, the blades 20 are approximately twelve inches in diameter which is effective for pallet shredding operations.

The blades 20*a* on the first shaft 18*a* are separated by the width of an opposite blade 20*b* on the second shaft 18*b*, plus a small distance for clearance between the alternating blades 20 of the first shaft 18*a* and second shaft 18*b* in the central shredding area 32. Similarly, the blades 20*b* on the second shaft 18*b* are separated by the width of an opposite blade 20*a* on a first shaft 18*a,* plus a small distance for clearance between the alternating blades 20 of the first shaft 18*a* and the second shaft 18*b* in the central shredding area 32.

There also can be a varying number of blades 20 on each shaft 18 so long as there are a sufficient number of blades 20 to adequately perform a given shredding operation such as shredding pallets. For example, in the preferred embodiment, there are eleven blades 20 on each shaft 18. However, more or less blades 20 would also be within the teachings of the invention. A different number of blades 20 would make sense if the blades were wider (meaning less blades would be needed) or thinner (meaning more blades would be needed). Also, a different number of blades 20 would be used if a wider or smaller spacing was used between the blades.

The blades 20 are generally cam-shaped, i.e., they each have an outer perimeter that is eccentric with respect to the axis of the corresponding one of the shafts 18*a* and 18*b*. In the preferred embodiment, the blades start in a first position 44, with the teeth 42 of the blade 20 being drawn away from the central shredding area 32 and corresponding blades 20 on opposite ones of the shafts 18*a* and 18*b* disposed in only slightly overlapping relation. Initially the first shaft 18*a* moves clockwise about its axis and the second shaft 18*b* moves counterclockwise in unison about its axis, with the teeth 42 of the blades 20 on both the first shaft 18*a* and second shaft 18*b* moving rotationally with the shafts about their respective axes toward the pallet and the central shredding area 32. The blades 20 initially grab the pallet, pulling it into the central shredding area 32. The pallet is then pulled down further into the central shredding area 32 where the pallet is shredded due to the substantial interleaved overlap produced by this rotational movement of the generally cam-shaped blades 20 coupled with the action of the teeth 42 and the small clearance between the final tooth and the opposing shaft. Once the shafts 18*a* and 18*b* and the blades 20 have rotated approximately 120 degrees to a second position 46, the first shaft 18*a* rotates counterclockwise and the second shaft 18*b* rotates clockwise in unison, moving the teeth 42 of the blades 20 away from the pallet and the central shredding area 32, back to the first position 44. The reciprocating pattern of moving the blades 20 between the first position 44 and the second position 46 causes more and more of the pallet to be pulled into the central shredding area 32, and it continues until the pallet is fully shredded.

Figure 4:
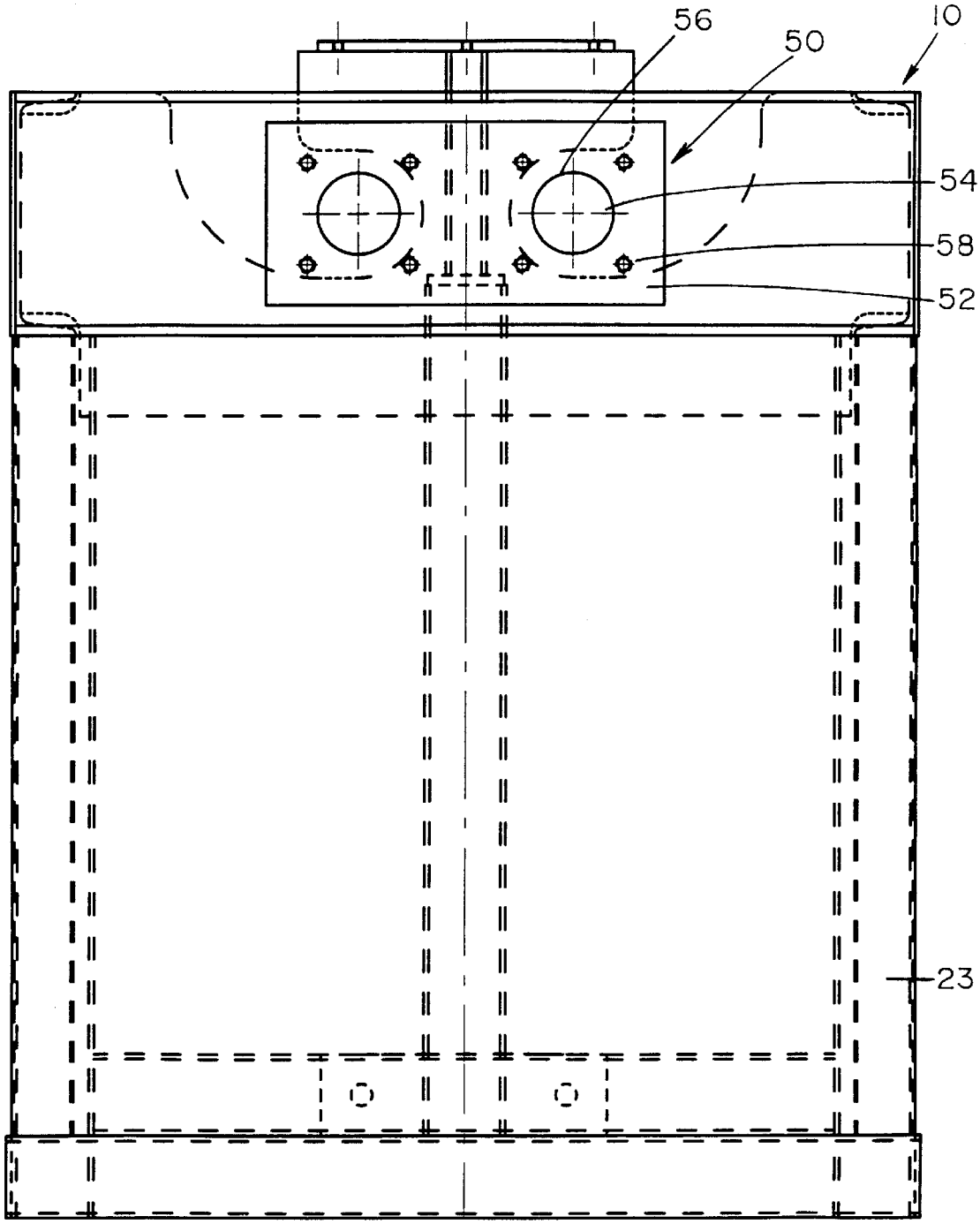
FIG. 4 is a partial cutaway side view of a pallet shredding device frame in accordance with the teachings of the present invention illustrating one embodiment of the pallet shredding device.

As best shown in FIG. 3 and FIG. 4, the first ends 48*a* and 48*b* of the shafts 18*a* and 18*b* are held in place using removable bearing pins 50*a* and 50*b*. The shaft ends 48*a* and 48*b* are provided with bearing holes 54 for mounting bearings 56. The mounting plate 52 has mounting holes 58 for affixing the removable bearing pins 50 to the frame 23 of the pallet shredding device 10 with any variety of removable fasteners. The removable bearing pins 50 support the shafts 18*a* and 18*b* via contact with bearings 56 mounted in shaft ends 48*a* and 48*b*. The bearings 56 in the shaft ends 48*a* and 48*b* are any bearings 56 of sufficient strength to withstand the forces inherent in the pallet shredding process. Similarly, the removable bearing pins 50 can be made from any material such as steel which is strong enough to withstand the forces of the shredding operation.

In the preferred embodiment, the removable bearing pins 50 are held to the frame 23 of the pallet shredding device 10 using bolts through the mounting boles 58 in the mounting plate 52. Once these bolts are removed, the removable bearing pins 50 can be removed from the pallet shredding device 10. In addition, the second ends 60*a* and 60*b* of the shafts 18*a* and 18*b* are supported in suitable bearings that are attached to the frame 23 in a similar fashion as ends 48*a* and 48*b* using removable bearing pins 50. The removable bearing pins 50 can easily be removed from their bearings, allowing the shafts and attached blades 20 to be removed from the pallet shredding device 10 once the removable bearing pins 50 have been removed. In this manner, it is possible to maintain, repair or replace the shafts 18*a* and 18*b* and associated blades 20 in a minimum of time without the need for special tools or equipment.

Of course, persons of ordinary skill in the art will appreciate that the present invention is not limited to any particular structure or environment of use and that the pallet shredding device described herein can take different forms and be used in any desired application without departing from the scope of the invention. Thus, while the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A material shredding device comprising:

a power source;

a first shaft and a second shaft disposed in generally parallel relation and being in communication with the power source for opposite reciprocating rotational movement in synchronized manner about respective axes thereof;

a plurality of blades attached to the first shaft and the second shaft which are interleaved so as to overlap over a central shredding area and undergo opposite reciprocating rotational movement in synchronized manner with the shafts between first and second positions; and a material feeding mechanism.

2. The material shredding device of claim 1, wherein the material feeding mechanism has a stationary portion and a moveable door portion.

3. The material shredding device of claim 2, wherein the moveable door portion of the material feeding mechanism is movable between a first closed position and a second open position.

4. The material shredding device of claim 1, wherein the stationary portion of the material feeding mechanism has a generally vertical orientation.

5. The material shredding device of claim 1, wherein the material feeding mechanism pivots between a first position and a second position.

6. The material shredding device of claim 1, wherein the material feeding mechanism is a material-receiving hopper.

7. The material shredding device of claim 1, wherein the power source is at least one hydraulic cylinder.

8. The material shredding device of claim 1 wherein the first and second shafts are connected to the power source through individually pivoting transfer arms.

9. The material shredding device of claim 1, wherein first ends of the first and second shafts are held in place with removable bearing pins.

10. The material shredding device of claim 1, wherein the blades on the respective shafts are alternately disposed over the central shredding opening.

11. The material shredding device of claim 1, wherein the blades on the first shaft overlap the blades of the second shaft by approximately 1½ inches when the blades are in the second position.

12. The material shredding device of claim 1, wherein each of the blades have a plurality of teeth.

13. The material shredding device of claim 1, wherein the first position of the teeth and the second position of the teeth are separated by greater than 90 degrees.

14. The material shredding device of claim 1, wherein the central shredding area is created between the opposite set of teeth when the teeth are in the first position.

15. A shredding device comprising:

a power source;

a first shaft and a second shaft disposed in generally parallel relation, each with a first end and a second end, being in communication with the power source for opposite reciprocating rotational movement in synchronized manner about respective axis thereof;

a plurality of blades attached to the first shaft and the second shaft which are interleaved so as to overlap over a central shredding area and undergo opposite reciprocal rotational movement in synchronized manner with the shafts between a first and second position;

the first ends of the first and second shafts are held in place with removable bearing pins; and a material feeding mechanism with a stationary portion and a moveable door portion.

* * * * *